US005095801A

United States Patent [19]

Lopez de Cardenas

[11] Patent Number: 5,095,801

[45] Date of Patent: Mar. 17, 1992

[54] PIVOT GUN HAVING CHARGES WHICH SLIDINGLY ENGAGE A STATIONARY DETONATING CORD AND APPARATUS FOR DEPLOYING THE CHARGES

[75] Inventor: Jorge E. Lopez de Cardenas, Sugar Land, Tex.

[73] Assignee: Schlumberger Technology Corporation, Houston, Tex.

[21] Appl. No.: 666,837

[22] Filed: Mar. 8, 1991

[51] Int. Cl.[5] ..... E21B 43/118

[52] U.S. Cl. ..... 89/1.15; 175/4.53

[58] Field of Search ..... 175/4.53, 4.6; 102/310; 89/1.15

[56] References Cited

U.S. PATENT DOCUMENTS

| | | | |
|---|---|---|---|
| 2,543,814 | 3/1951 | Thompson et al. | 175/4.53 |
| 2,639,770 | 5/1953 | Huber | 175/4.53 |
| 2,644,519 | 7/1953 | Kanady | 175/4.53 |
| 2,664,157 | 12/1953 | Abendroth | 175/4.53 |
| 2,664,158 | 12/1953 | McKean | 175/4.53 |
| 2,859,697 | 11/1958 | Long | 175/4.53 |
| 2,883,932 | 4/1959 | Caldwell | 175/4.53 |
| 2,889,775 | 6/1959 | Owen | 102/310 |
| 2,912,930 | 11/1969 | Caldwell | 175/4.53 |
| 2,924,173 | 2/1960 | Robertson | 175/4.53 |
| 2,947,253 | 8/1960 | Cirilo | 175/4.53 |
| 2,960,931 | 11/1960 | Douglass | 175/4.53 |
| 2,974,589 | 3/1961 | Bryan | 175/4.53 |
| 2,990,774 | 7/1961 | Toelke | 102/310 |
| 3,010,396 | 11/1961 | Coleman | 175/4.55 |
| 3,018,730 | 1/1962 | Castel | 102/310 |
| 3,067,678 | 12/1962 | Caldwell et al. | 175/4.53 |
| 3,067,679 | 12/1962 | Caldwell et al. | 175/4.53 |
| 3,071,072 | 1/1963 | Castel et al. | 175/4.53 |
| 3,104,611 | 9/1963 | Baks | 175/4.6 |
| 3,107,611 | 10/1963 | Caldwell et al. | 175/4.53 |
| 3,107,612 | 10/1963 | Caldwell et al. | 175/4.53 |
| 3,116,689 | 1/1964 | Sumner | 175/4.53 |
| 3,194,159 | 7/1965 | Gillingham et al. | 175/4.53 |
| 3,327,791 | 6/1967 | Harrigan, Jr. | 175/4.55 |
| 3,768,408 | 10/1973 | Hallmark | 102/320 |
| 3,773,120 | 11/1973 | Stroud et al. | 175/4.55 |
| 4,961,365 | 10/1990 | Rytlewski | 89/1.15 |

*Primary Examiner*—David H. Brown

*Attorney, Agent, or Firm*—Henry N. Garrana; John H. Bouchard

[57] ABSTRACT

A pivot gun through-tubing perforating apparatus, which is adapted to be lowered through a tubing in a borehole, includes a perforating gun section and a deployment head section. The perforating gun section includes a plurality of charges which rotate or pivot about an axis during deployment, and a stationary detonating cord. When each charge rotates during deployment, a top of each charge slidingly engages with a stationary detonating cord. The deployment head includes a first explosive bolt, a second explosive bolt, and a piston having a contact finger which is adapted to contact either one of three switch contacts. When the contact finger contacts a first and second switch contact, the first explosive bolt is connected to a voltage source and each of the charges are short circuited to ground potential. In this condition, the charges cannot detonate, and, when the first explosive bolt detonates, the charges begin to deploy in response to movement of the piston. When the contact finger moves from the first and second switch contact to a third switch contact, the short circuit to the charges is removed, and the charges are reconnected to the voltage source. In addition, the second explosive bolt is connected to the voltage source and the charges may then detonate when current is received from the voltage source. If the charges fail to detonate, the second explosive bolt facilitates the retrieval of the gun from within the tubing in the wellbore. If the second explosive bolt fails, a weak linkage between charges and pullrods enables the gun to be retrieved from within the tubing.

19 Claims, 2 Drawing Sheets

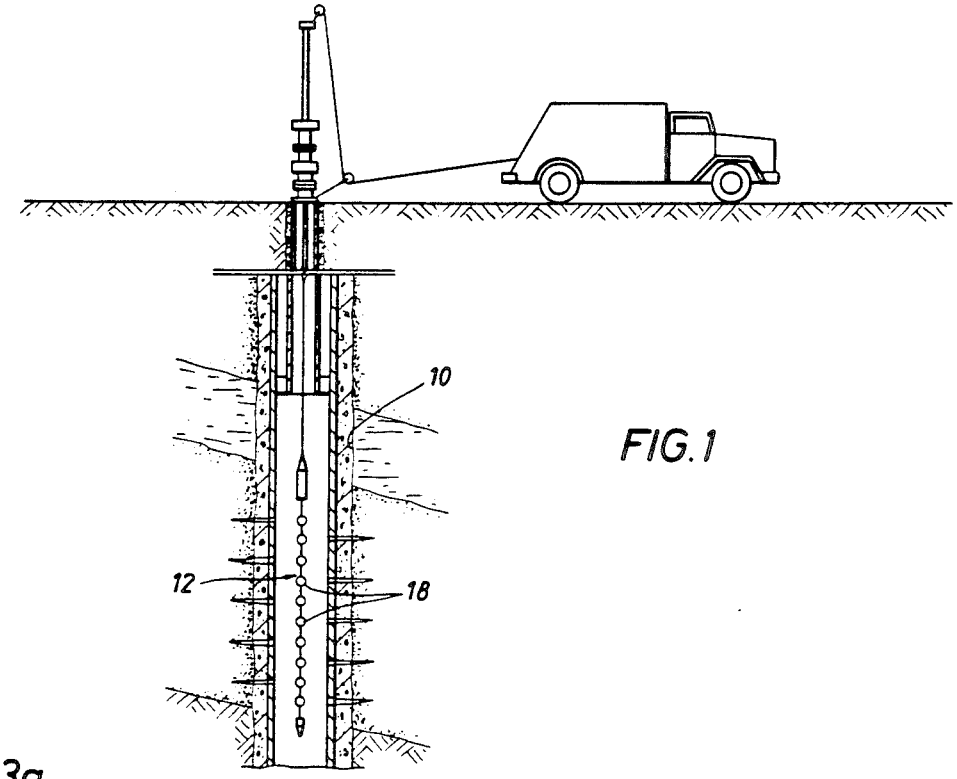
FIG. 1
FIG. 3a
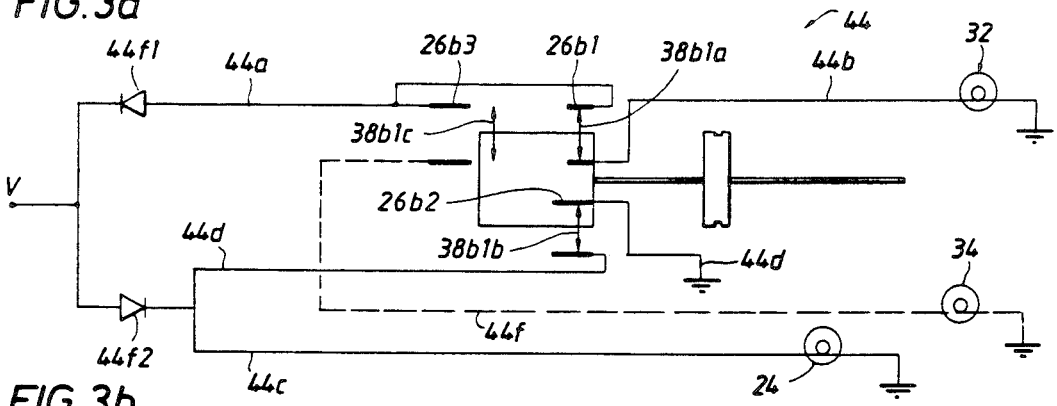
FIG. 3b
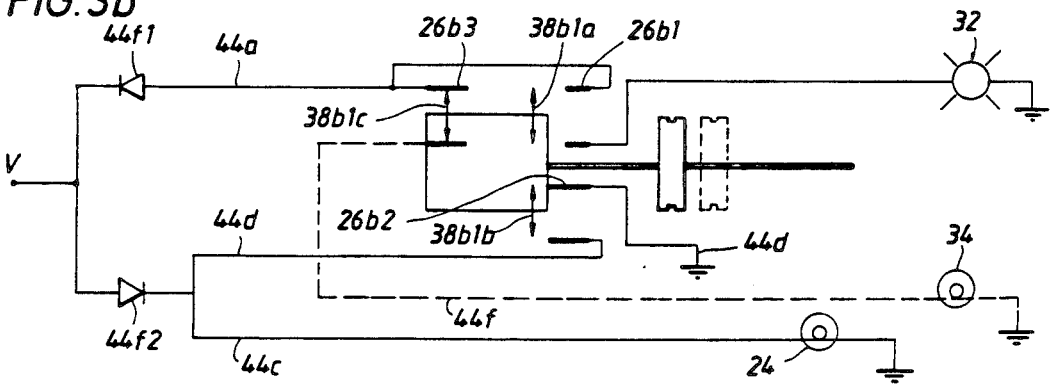

PIVOT GUN HAVING CHARGES WHICH SLIDINGLY ENGAGE A STATIONARY DETONATING CORD AND APPARATUS FOR DEPLOYING THE CHARGES

BACKGROUND OF THE INVENTION

The subject matter of the present invention relates to a perforating apparatus, and in particular, to a pivot gun through-the-tubing perforating apparatus, the pivot gun being adapted to be disposed within a tubing and including a plurality of rotatable shaped charges and a pair of release means, such as a pair of explosive bolts. The charges are adapted to rotate from a stored position to a deployed position and slidingly engage a stationary detonating cord during the rotation to the deployed position. The pair of release means each function to provide a release; that is, the charges pivot from the stored position to the deployed position in response to a release provided by the first release means; and, in the event the charges fail to detonate, the gun may more easily be retrieved from within the tubing when a release is provided by the second release means.

U.S. Pat. No. 4,961,365 to Rytlewski, assigned to the same assignee as that of the present invention and incorporated herein by reference, discussed several problems associated with prior art rotating charge perforating guns (otherwise known as pivot guns), which problems created a need for a new type of pivot gun. The Rytlewski patent satisfied this need by disclosing a pivot gun perforating apparatus having a mechanical link retaining mechanism for contacting and holding a detonating cord to a top of each charge and enabling the charges of the gun to pivot in response to a pull on a pullrod connected to each charge. Since the detonating cord is connected to the top of each charge, the cord moves in response to a corresponding rotational movement of the top of the charge. However, although the Rytlewski perforating apparatus satisfactorily satisfied the need, under certain circumstances, it may be more desirable to allow the detonating cord to remain stationary during rotational movement of the charges. Furthermore, in the Rytlewski patent, the implementation for producing the pull on the pullrod and rotating the charges was not disclosed.

SUMMARY OF THE INVENTION

Accordingly, it is a primary object of the present invention to provide a pivot gun perforating apparatus including a plurality of charges, each of which are adapted to rotate about an axis and which slidingly engage a stationary detonating cord during the rotation.

It is a further object of the present invention to provide an implementation for providing a pull on a pullrod connected to each charge of the pivot gun, the implementation including a first release means for releasing the pullrod from a stationary object, a biasing means for pulling the pullrod upwardly in a tubing relative to the stationary object from a first position to a second position in response to the release provided by the first release means thereby deploying the plurality of charges to a deployed position.

It is a further object of the present invention to further provide a second release means in the event the plurality of deployed charges of the gun fail to detonate and perforate a wellbore, or in the event the pivot gun, for any reason, must be pulled out of the wellbore in which it is disposed, the second release means releasing the pullrod from its second position thereby enabling the deployed charges to retract to a stored position.

It is a further object of the present invention to provide a redundancy for the second release means in the event the second release means fails to operate properly, the redundancy comprising a mechanical linkage mechanism disposed between each charge and the pullrods, the linkage mechanism being weak and frangible and adapted to break when the deployed charges are pulled up into the tubing thereby releasing the charges from the pullrods and enabling the charges to rotate from the deployed position to the stored position.

In accordance with these and other objects of the present invention, a pivot gun perforating apparatus includes a gun section and a deployment head. The gun section includes a stationary detonating cord and a plurality of shaped charges connected to a gun carrier and to a pair of pullrods via a corresponding plurality of linkage mechanisms. Each of the charges are adapted to rotate from a stored position to a deployed position in response to a pull on the pullrods. When each charge rotates about its axis, one end of the charge slidingly engages with the stationary detonating cord. When each charge is fully deployed, the detonating cord contacts the charge in a manner which allows a detonating wave, propagating in the cord, to subsequently detonate the charge. The deployment head provides the implementation for deploying the charges. The deployment head includes a first release means for releasing the pullrods from a stationary object; a biasing means for providing a pulling force on the pullrods when the first release means releases the pullrods from the stationary object thereby rotating the charges to a deployed position, maintaining said pulling force on the pullrods, and maintaining the charges in the deployed position; and a second release means for releasing the pulling force from the pullrods thereby releasing the deployed charges from the deployed position. The pivot gun is a through the tubing type of gun. Therefore, in the event an emergency retrieval of the gun from the wellbore is required after the charges haven been deployed, the second release means functions to release the pulling force which is being exerted on the pullrods. As a result, the charges pivot from the deployed position to a semi-stored position. When the gun is pulled into the tubing, the charges close to a stored position. In the event the second release means fails to operate properly, a redundancy for the second release means comprises a relatively weak linkage mechanism which connects each charge to the pullrods; when the gun with deployed charges is pulled into the tubing, the linkage mechanism breaks thereby allowing the deployed charges to rotate to the stored position.

Further scope of applicability of the present invention will become apparent from the detailed description presented hereinafter. If should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIG. 1 illustrates a pivot gun perforating apparatus including rotatable charges disposed in a wellbore;

FIGS. 3a-3b illustrate a diagram of a circuit for releasing the first release means thereby deploying the pivot gun and short circuiting the charges when the gun is disposed in the closed position and for disabling the short circuit and releasing the second release means when the gun is disposed in the deployed position.

DETAILED DESCRIPTION OF THE PREFERRED EMBODIMENT

Figure 2A:
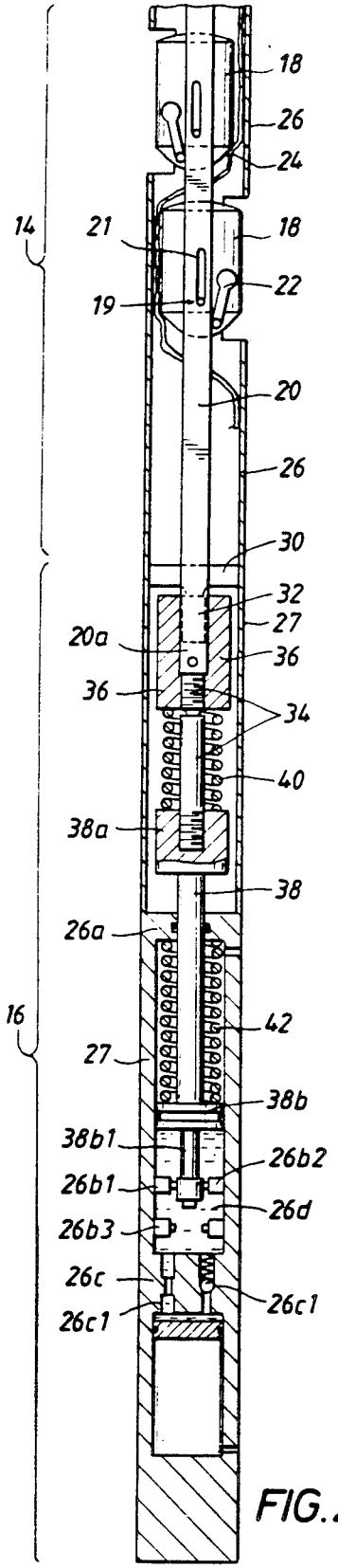
FIGS. 2a-2c illustrates the pivot gun perforating apparatus when disposed in a closed position, a deployed position, and an emergency retrieval position.

Referring to FIG. 1, the pivot gun perforating apparatus 12 of the present invention is disposed in a borehole 10. The pivot gun perforating apparatus 12 includes a plurality of rotatable charges 18, the perforating apparatus 12 being a pivot gun because each of the charges 18 are adapted to rotate about an axis from a stored position to a deployed position. When deployed, the charges 18 of the pivot gun 12 detonate and penetrate the formation. Deployment of the pivot gun 12 involves rotation of the pivot gun charges 18 from a stored position to a deployed position, the stored position being defined as one where the axis of a charge 18 is parallel to the axis of the gun 12, the deployed position being defined as one where the axis of the charge 18 is perpendicular to the axis of the gun 12.

Figure 2B:
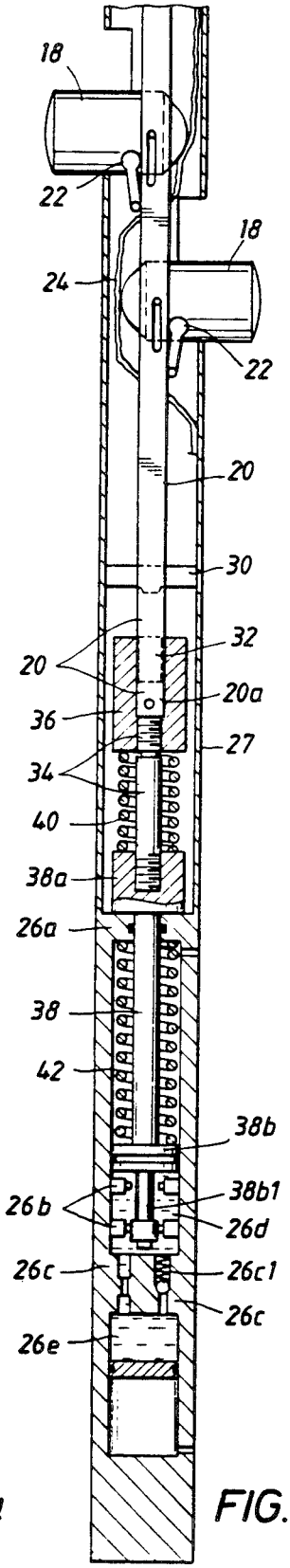
Figure 2C:
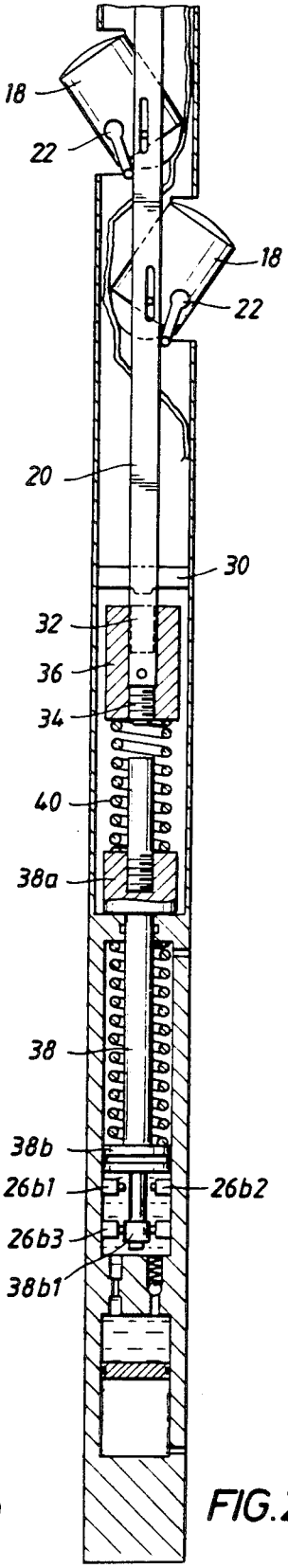

Referring to FIGS. 2a-2c, a construction of the pivot gun 12 of the present invention is illustrated. In FIG. 2a, the pivot gun 12 is disposed in a closed position. In FIG. 2b, the pivot gun 12 is disposed in a deployed position. In FIG. 2c, the pivot gun 12 is disposed in an emergency retrieval position; when disposed in this position, it is easier to retrieve the gun 12 from a tubing in a borehole.

The pivot gun 12 includes a perforating gun section 14 and a deployment head section 16.

The perforating gun section 14 includes a plurality of charges 18 adapted to rotate about an axis, each charge 18 having a pin 19 disposed on each side of the charge; a pullrod 20 connected via a linkage 22 to each side of each charge 18, each pullrod 20 having a slot 21 in which the pin 19 of a charge is adapted to be disposed; the linkage 22 connecting each charge 18 to the pullrod 20; a gun carrier 26; and a detonating cord 24 which is stationarily disposed within the gun carrier 26. The linkage 22 is weak and will break when a force exceeding a predetermined value is exerted on the linkage; this is an important characteristic of the linkage 22 since it provides a redundancy in the event the second release means fails to operate, a concept which will be discussed in more detail later in this specification. The detonating cord 24 is stationary relative to carrier 26; that is, it does not move relative to the gun carrier 26. This is an important characteristic of the perforating gun section 14, since, during rotation, the charges 18 will slidingly engage with the stationary detonating cord 24 thereby ensuring adequate contact with each charge in spite of the rotational requirements of each charge 18 of the pivot gun 12. The carrier 26 includes built-in clips that hold the detonating cord stationary relative to the carrier 26 and ensure good position and contact of the detonating cord 24 relative to the charge 18.

The deployment head 16 of the pivot gun 12 includes a deployment head housing 27; and components disposed within the deployment head housing 27, which components include a stationary object 30, a first release means 32 connected to the stationary object 30, the first release means 32 being a first explosive bolt 32, a second release means 34, the second release means 34 being a second explosive bolt 34, a member 36 which holds the first and second explosive bolts 32 and 34 together, a piston 38, and a first spring 40 disposed between the piston 38 and the member 36. In lieu of the explosive bolt, the first and second release means 32 and 34 may each comprise either a solenoid or a resistorized screw. The top 20a of each pullrod 20 is firmly connected to member 36 and is movable with the movement of member 36. The piston 38 includes a first end 38a and a second end 38b, the second end 38b further including a contact finger 38b1. As will be shown with reference to FIGS. 3a-3b, the contact finger 38b1 includes a first contact finger 38b1a, a second contact finger 38b1b, and a third contact finger 38b1c. The deployment head housing 27 includes a transverse part 26a and a pair of switch contacts 26b, the switch contacts 26b including a first switch contact 26b1, a second switch contact 26b2, and a third switch contact 26b3. A second spring 42 is disposed between the second end 38b of piston 38 and the transverse part 26a of the deployment head housing 27. The contact finger 38b1 of the second end 38b of the piston 38 is adapted to first contact the first switch contact 26b1 and the second switch contact 26b2 and subsequently the third switch contact 26b3, in response to the movement of piston 38 within the deployment head housing 27, the piston 38 moving in response to the biasing action of the second spring 42 when the first release means 32 (e.g., first explosive bolt 32) releases the member 36 from the stationary object 30. A first internal space 26d, in which the switch contacts 26b are disposed, is defined by the second end 38b of piston 38, the deployment head housing 27, and a further transverse part 26c of the deployment head housing 27, the first internal space 26d containing oil. Therefore, the deployment head housing 27 includes the transverse part 26a and the further transverse part 26c. The first internal space 26d is disposed on one side of the further transverse part 26c of the deployment head housing 27 and a second internal space 26e is disposed on the other side of further transverse part 26c. In addition, the further transverse part 26c includes a first and second oil metering orifice 26c1 disposed longitudinally through the further transverse part 26c, the first oil metering orifice allowing the oil in first internal space 26d to move to the second internal space 26e, the second oil metering orifice allowing the oil in second internal space 26e to move to the first internal space 26d.

The first, second and third switch contacts 26b1, 26b2, and 26b3 are connected to a switch contact circuit 44 (FIGS. 3a-3b) which is responsible for: (1) energizing and exploding the explosive bolt 32 at the proper time thereby allowing the charges 18 to deploy to the deployed position from the closed position, (2) preventing the charges 18 from detonating when disposed in the closed position, (3) enabling the charges 18 to detonate when disposed in the deployed position, and (4) energizing and exploding the explosive bolt 34 thereby facilitating the retrieval of the pivot gun 12 from a tubing in a borehole during an emergency when retrieval of the gun is necessary.

Referring to FIG. 3a-3b, a diagram of the switch contact circuit 44, connected to the first, second and third switch contacts 26b1, 26b2, and 26b3 is illustrated.

In FIG. 3a, the switch contact circuit 44 includes the first switch contact 26b1, the second switch contact 26b2 and the third switch contact 26b3. As noted above, the contact finger 38b1 includes the first contact finger 38b1a, the second contact finger 38b1b, and the third contact finger 38b1c. In FIG. 3a, the first and second contact fingers 38b1a and 38b1b contact the switch contacts 26b1 and 26b2. A voltage source V is connected to the switch contact 26b2 via rectifier 44f1 on line 44a. Switch contact 26b1 of FIG. 3a is further connected to the first release means 32 (first explosive bolt 32) via line 44b. Therefore, the voltage source V is connected to the first explosive bolt 32 via line 44a and 44b. The voltage source V is also connected to a booster of a detonating cord via a rectifier 44f2 of opposite polarity to rectifier 44f1, and the booster is further connected to the detonating cord 24 of pivot gun 12 via line 44c. However, line 44c is short circuited in FIG. 3a because contact finger 38b1b contacts the switch contact 26b2 thereby connecting line 44c to ground potential via line 44d.

In FIG. 3b, the contact finger 38b1c contacts the switch contact 26b3. The voltage source V is connected to the switch contact 26b3 via line 44a; however, the switch contact 26b3 is connected to the second explosive bolt 34 via line 44f. The voltage source V is also connected to the booster of the detonating cord 24 via line 44c, as shown in FIG. 3a; however, line 44c is no longer short circuited because contact finger 38b1 has moved from switch contact 26b1/26b2 to switch contact 26b3 thereby disconnecting the lines 44c and 44d from the ground potential.

A functional description of the present invention will be set forth in the following paragraphs with reference to FIGS. 2a-2c and 3a-3b of the drawings.

Originally, the pivot gun 12 is disposed in the closed position, as shown in FIG. 2a of the drawings. The pivot gun 12 is a through-the-tubing type of perforating gun and is adapted to be disposed below the tubing when suspended by wireline or other such apparatus within a borehole. In FIG. 3a, if the voltage source V is connected in the correct polarity, the voltage source V sends its current (in a polarity which conducts through rectifier 44f1) through the switch contact 26b1 via line 44a and the first explosive bolt 32 via line 44b thereby exploding the first explosive bolt 32. However, if the voltage source is connected in the wrong polarity, the voltage source V sends its current to ground potential via switch contact 26b2 and line 44d; as a result, even if the voltage source V is connected in the wrong polarity, the current cannot reach line 44c (which is connected to the detonating cord 24 of the pivot gun 12). Therefore, the pivot gun 12 cannot shoot its charges when disposed in the closed position of FIG. 2a.

In FIG. 2b, the first explosive bolt 32 has exploded thereby separating the member 36 from the stationary object 30. Spring 42 forces piston 38 to move from right to left in FIG. 2b. Since the top 20a of pullrods 20 is connected to member 36, and is movable with member 36, movement of piston 38 from right to left in FIG. 2b forces pullrods 20 to also move from right to left in FIG. 2b (or uphole when disposed in the borehole of FIG. 1). The oil disposed in the first internal space 26d begins to move through one of the oil metering orifices 26c1 (the top orifice shown in FIG. 2b); however, since the oil moves very slowly through the orifice, the piston 38 and pullrods 20 also move very slowly from right to left in FIG. 2b (or uphole in the borehole) in response to the biasing action of spring 42. Pullrods 20 pull on linkage 22; and, since linkages 22 are connected to charges 18, the pull on linkages 22 rotates the charges 18, as shown in FIG. 2b. As the charges 18 rotate to their fully deployed position, as shown in FIG. 2b, the top of each charge slidingly engages with the stationary detonating cord 24; and, when fully deployed, the top of charges 18 contact the detonating cord 24. However, until contact finger 38b1b actually moves enough to open the circuit on contact 26b2, the detonating cord 24 remains short circuited via line 44d of FIG. 3a. However, when the charges 18 are fully deployed, contact finger 38b1b is no longer in contact with switch contact 26b2; contact finger 38b1a has moved away from contact 26b1 opening the circuit of line 44a; finger contact 38b1c is now in contact with switch 30 26b3; and, as a result, the voltage source V could be connected to the second explosive bolt 34 via line 44f (FIG. 3b). Since the voltage source V is now connected to detonating cord 24 (and is not short circuited), a current on line 44c from voltage source V, of a polarity conducting through rectifier 44f2, will detonate the booster of the detonating cord 24 sending a detonation wave down the detonating cord 24 to each of the charges 18 of the pivot gun 12 thereby detonating the charges 18. If the charges 18 detonate, the pullrods, linkages, and other parts of the gun shatter into small pieces and fall into the bottom of the wellbore.

However, if the charges 18 or the booster fail to detonate, or if for any other reason it is necessary to pull the gun out of the wellbore after the charges 18 have been deployed but have not detonated, a subsequent or concurrent current from voltage source V is transmitted along line 44f to the second explosive bolt 34 (see FIG. 3b) thereby exploding the second explosive bolt 34. In FIG. 2c, when the second explosive bolt 34 detonates, the first end 38a of piston 38 is physically separated from member 36 and pullrods 20. The charges 18 and pullrods 20 are now released from piston 38. When a user at the well surface pulls the pivot gun 12 uphole, the charges 18 physically hit the end of the tubing thereby causing the charges 18 to rotate from the deployed position toward the closed position and allowing the pivot gun 12 to be retrieved from the borehole.

If the above mechanism would fail to operate, it is still possible to retrieve the gun from the wellbore, even if the charges 18 are still deployed. This can be achieved by pulling the gun slowly into the tubing and allowing the tubing to break the linkage 22 of every charge 18 as the charges 18 go through the tubing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A perforating apparatus including a plurality of charges and a stationary detonating cord adapted for conducting a detonation wave, each charge of the plurality of charges being adapted to rotate about an axis, comprising:

means for rotating said each charge about said axis, an and or said each charge slidingly engaging said stationary detonating cord during the rotation of said each charge, said means for rotating including pulling force application means for applying a pulling force to a side of said each charge during the rotation of said each charge about said axis, the pulling force application means including a pullrod connected to the side of said each charge adapted for applying said pulling force to said side of said each charge, and further pulling force application means for applying a corresponding pulling force to said pullrod.

said detonation wave conducting in said detonating cord to said end of said each charge thereby detonating said each charge.

2. The perforating apparatus of claim 1, further comprising a stationary object, and wherein said further pulling force application means comprises:

release means disposed between said pullrod and said stationary object for releasing said pullrod from said stationary object in response to a stimulus; and biasing means for applying said corresponding pulling force to said pullrod thereby rotating said each charge about said axis from a stored position to a deployed position and allowing said end of said each charge to slidingly engage said stationary detonating cord during the rotation when said release means releases said pullrod from said stationary object.

3. The perforating apparatus of claim 2, wherein said release means comprises an explosive bolt.

4. The perforating apparatus of claim 2, further comprising:

further release means disposed between said biasing means and said pullrod for interrupting the application of said corresponding pulling force from said biasing means to said pullrod in response to a further stimulus thereby allowing said each charge to rotate from said deployed position to said stored position.

5. The perforating apparatus of claim 4, wherein said further release means comprises an explosive bolt.

6. A method of detonating a perforating apparatus which includes a rotatable charge, a stationary detonating cord, a stationary object, a pullrod having one end connected to said charge and another end connected to said stationary object, and pulling means connected to said another end of said pullrod for applying a pulling force to said another end of said pullrod, comprising the steps of:

releasing said another end of said pullrod from said stationary object;

applying said pulling force to said another end of said pullrod, rotating said charge from a stored position to a deployed position in response to said pulling force;

during the rotation of said charge to said deployed position, slidingly contacting an end of said charge against said stationary detonating cord; and detonating said charge when said charge is disposed in the deployed position.

7. The method of claim 6, further comprising the step of:

applying a ground potential to said charge thereby preventing said charge from detonating when said charge is disposed in said stored position.

8. The method of claim 7, further comprising the step of:

removing said ground potential from said charge thereby enabling said charge to detonate when said charge is disposed in said deployed position.

9. The method of claim 8, further comprising the step of:

following said removing step and after said charge detonates, interrupting said pulling force being applied to said another end of said pullrod, said charge being adapted to rotate from said deployed position to said stored position when said pulling force being applied to said another end of said pullrod is interrupted.

10. The method of claim 8, wherein said perforating apparatus includes a linkage connected between said one end of said pullrod and said charge, further comprising the step of:

following said removing step and after said charge detonates, breaking said linkage between said one end of said pullrod and said charge, said charge being adapted to rotate from said deployed position to said stored position when said linkage is broken.

11. A perforating apparatus including a plurality of charges and a stationary detonating cord adapted for conducting a detonation wave, each charge of the plurality of charges being adapted to rotate about an axis, comprising:

means for rotating said each charge about said axis, an end of said each charge slidingly engaging said stationary detonating cord during eh rotation of said each charge, said means for rotating including pulling force application means for applying a pulling force to a side of said each charge during the rotation of said each charge about said axis, the pulling force application means including a pullrod connected to the side of said each charge adapted for applying said pulling force to said side of said each charge, and further pulling force application means for applying a corresponding pulling force to said pullrod including release means disposed between said pullrod and a stationary object for releasing said pullrod from said stationary object in response to a stimulus, and biasing means for applying said corresponding pulling force to said pullrod thereby rotating said each charge about said axis from a stored position to a deployed position and allowing said end of said each charge to slidingly engage said stationary detonating cord during the rotation when said release means releases said pullrod from said stationary object;

further release means disposed between said biasing means and said pullrod for interrupting the application of said corresponding pulling force from said biasing means to said pullrod in response to a further stimulus thereby allowing said each charge to rotate from said deployed position to said stored position;

a voltage source adapted to provide said stimulus and said further stimulus; and a circuit interconnecting said each charge and said release means to said voltage source, said circuit including a first circuit means for applying said stimulus from said voltage source to said release means thereby enabling the release of said pullrod from said stationary object and simultaneously short circuiting said each charge to a ground potential thereby preventing a detonation of said each charge when said each charge is disposed in said stored position.

12. The perforating apparatus of claim 11, wherein said circuit further includes a second circuit means for removing the ground potential from said each charge thereby enabling said detonation of said each charge and subsequently applying said further stimulus from said voltage source to said further release means thereby interrupting the application of said corresponding pulling force from said biasing means to said pullrod in response to said detonation when said release means releases said pullrod from said stationary object and said biasing means rotates said each charge to said deployed position.

13. A perforating apparatus including a plurality of charges and a stationary detonating cord adapted for conducting a detonation wave, each charge of the plurality of charges being adapted to rotate about an axis, comprising:

pulling force application means for applying a pulling force to a side of said each charge thereby rotating said each charge about said axis, an end of said each charge slidingly engaging said stationary detonating cord during the rotation of said each charge, the pulling force application means including a pullrod connected to the side of said each charge adapted for applying said pulling force to said side of said each charge, and further pulling force application means for applying a corresponding pulling force to said pullrod, said detonation wave conducting in said detonating cord to said end of said each charge thereby detonating said each charge.

14. The perforating apparatus of claim 13, wherein said further pulling force application means comprises:

release means interconnecting said pullrod to a stationary object for releasing said pullrod from said stationary object in response to a stimulus; and biasing means connected to said pullrod and responsive to the release provided by said release means for applying said corresponding pulling force to said pullrod thereby applying said pulling force to said side of each charge and rotating said each charge about said axis from a stored position to a deployed position when said release means releases said pullrod from said stationary object, said end of said each charge slidingly engaging said stationary detonating cord during the rotation.

15. The perforating apparatus of claim 14, wherein said release means comprises:

a voltage source adapted for providing said stimulus;

explosive means disposed between the pullrod and the stationary object for providing an explosive charge thereby releasing the pullrod from the stationary object; and circuit means interconnecting said each charge and said explosive means to said voltage source for applying said stimulus from said voltage source to said explosive means thereby providing said explosive charge from said explosive means and releasing said pullrod from said stationary object.

16. The perforating apparatus of claim 15, wherein said circuit means further comprises:

short circuit means for short circuiting said each charge to a ground potential prior to and during the release of said pullrod from said stationary object thereby preventing a detonation of said each charge when said each charge is disposed in said stored position.

17. The perforating apparatus of claim 16, wherein said circuit means further comprises:

removing means responsive to the release of the pullrod from the stationary object and the rotation of said each charge to said deployed position for subsequently removing the ground potential from said each charge thereby enabling said each charge to detonate.

18. The perforating apparatus of claim 17, wherein sad circuit means further comprises:

interruption means responsive to the detonation of said each charge for interrupting the application of said corresponding pulling force from said biasing means to said pullrod thereby allowing said each charge to rotate from said deployed position to said stored position.

19. The perforating apparatus of claim 18, wherein said interruption means comprises:

further explosive means interconnected between said biasing means and said pullrod and responsive to said stimulus from said voltage source for providing an explosive charge in response to said stimulus and disconnecting said biasing means from said pullrod thereby interrupting the application of said corresponding pulling force from said biasing means to said pullrod, said each charge being rotatable from said deployed position to said stored position when the application of said corresponding pulling force from said biasing means to said pullrod is interrupted.

* * * * *